United States Patent [19]

Miraglia

[11] Patent Number: 4,948,118

[45] Date of Patent: Aug. 14, 1990

[54] SUPPORT APPARATUS FOR WATER EXERCISE AND THERAPY

[76] Inventor: Louis Miraglia, W. 308 Cleveland, Spokane, Wash. 99205

[21] Appl. No.: 273,095

[22] Filed: Nov. 18, 1988

[51] Int. Cl.[5] ..... A63B 31/00

[52] U.S. Cl. ..... 272/71; 272/70; 272/131; 104/62

[58] Field of Search ..... 272/70, 70 A, 131, 71; 128/25 R; 104/62, 91, 93, 112, 113; 119/29; 434/254

[56] References Cited

U.S. PATENT DOCUMENTS

| | | | |
|---|---|---|---|
| 654,687 | 7/1900 | Suter | 104/93 |
| 793,288 | 6/1905 | Faber | 272/71 |
| 2,812,010 | 11/1957 | Abdallah | 272/70 A |
| 2,893,518 | 7/1959 | Vanderbeck | 104/93 |
| 3,445,941 | 5/1969 | Eaves et al. | 272/71 X |
| 3,985,082 | 10/1976 | Barac | 272/70 A |
| 4,445,502 | 5/1984 | Swan et al. | 104/62 |
| 4,841,871 | 6/1989 | Leibowitz | 104/91 X |

*Primary Examiner*—Richard J. Apley
*Assistant Examiner*—D. F. Crosby
*Attorney, Agent, or Firm*—Mark Zovko

[57] ABSTRACT

Apparatus for supporting a user in a pool of water for therapeutic or training purposes. An overhead unit having tracks which guide and support the wheels of a movable trolley is provided. A cable having one end attached to the trolley and one end connected to a support jacket worn by the user allows the user to be fully supported in the water. The user may move through the water along the line of the overhead rail. A brake is provided which can create a drag requiring an increase it the force needed to move the trolley along the rail thereby making the user work harder. The rail may be supported by attachment to a ceiling above the pool or supported by stanchions adjacent to the sides of the pool if portability of the apparatus is desired.

6 Claims, 3 Drawing Sheets

SUPPORT APPARATUS FOR WATER EXERCISE AND THERAPY

BACKGROUND OF THE INVENTION

1. Field of the Invention

This invention relates in general to swimming and water therapy and more particularly to apparatus for providing support for swimmers or physical therapy patients in a pool of water.

2. Discussion of the Prior Art

The field of physical therapy in swimming pools or the use of training devices in pools for accomplished athletes is a relatively new field. Limited equipment is presently available that is functional and practical. Physical therapists working with injured, partially paralyzed, or otherwise incapacitated individuals have had little choice of helpful equipment to improve the results obtained from working with these patients. Generally, equipment is needed that would strengthen and improve individuals ranging from those incapacitated to top athletes such as runners or swimmers. Ideally, any equipment used in a pool of water would provide less weight and stress on recovering muscles, ligaments, etc., and would have the capacity to allow suitable muscle strengthening for uninjured accomplished athletes.

A preliminary patent search was performed and the following results were obtained.

| U.S. Pat. No. | Inventor | Date Issued |
|---|---|---|
| 793,288 | Faber | 6/27/05 |
| 1,546,031 | Schofield | 7/14/25 |
| 1,752,630 | Brown | 4/1/30 |
| 3,445,941 | Eaves et al | 5/27/69 |
| 3,966,202 | Cynamon | 6/29/76 |
| 4,114,874 | Mattila | 9/19/78 |
| 4,247,096 | Schmitt | 1/27/81 |
| 4,527,795 | Zink | 7/9/85 |
| 4,530,497 | Moran et al | 7/23/85 |

Generally, these patents do not anticipate the present invention and have shortcomings or disadvantages relative to the apparatus disclosed herein. For example, U.S. Pat. No. 4,530,497, a device giving support for in-place swimming, is most useful for an accomplished swimmer and would not be suitable where the user required more support to stay above water. U.S. Pat. No. 4,527,795 discloses a swimming tank to be used with a harness mechanism which restricts forward progress by the swimmer. Again, the device is suitable only for accomplished swimmers and would not be of use to relatively new swimmers or physical therapy patients. U.S. Pat. No. 4,247,096 has the same shortcoming as the two previously discussed patents. Further, it can be remarked that this apparatus, although possibly effective for accomplished swimmers, would be psychologically frustrating to a swimming beginner or physical therapy patient due to limited support and lack of experiencing gradual progress by the user. U.S. Pat. No. 4,114,874 shows a tethering device for exercising swimmers in a pool having a dissimilar structure and result when compared to the present invention. The swimming apparatus shown in U.S. Pat. No. 3,966,202 shows a stationary support apparatus, once again having no means for physical therapy patients or beginners to experience gradual progress. A complicated motor driven apparatus is disclosed in U.S. Pat. No. 3,445,941 to Eaves which propels a user through the water much unlike the present invention. Patent No. 793,288 shows a swim training device supported on legs with a large base resulting in an extremely cumbersome apparatus which would interfere with normal use of a swimming pool. U.S. Pat. Nos. 1,752,630 and 1,546,031 show devices far afield from the present invention but which do support an individual in the water. From the results of the above discussed search it can be seen that the present invention offers a water support apparatus for physical therapy or exercise which is relatively uncomplicated, highly practical, and has advantages over the devices shown in the prior art. Futher, although the above references show the concept of movably supporting a swimmer in relationship to a body of water, the particular structure, function and result is not anticipated or rendered obvious by the above references either alone or in combination.

SUMMARY OF THE INVENTION

The present invention provides apparatus for supporting a user in a pool of water for therapeutic or training purposes. A lineal rail is mounted above the pool of water. The rail has two tracks which can support wheels of a trolley. The wheels of the trolley ride on the tracks of the rail and are guided and supported by the tracks of the rail. One end of a cable is mounted to the trolley, and the other end is adapted to receive and support the user in the pool of water. Movement of the user along the line of the rail results in lineal movement of the trolley along the rail as the user is supported in the pool of water.

The apparatus, in a preferred embodiment, also has a braking system which can increase the force necessary to move the trolley within the rail. The braking system is adjustable from a fully "free" setting in which no outside resistance is placed on the trolley to a fully "set" position in which maximum drag is applied to the underside of the rail which will keep the trolley stationary. The brake of the apparatus is adjustable in the preferred embodiment by the user of the apparatus.

The present invention contemplates two alternative methods of supporting the rail above the pool of water. In one method, the rail is mounted by conventional mounting techniques to the ceiling of the room containing the swimming pool. In this embodiment, the rail is mounted in a relatively permanent way. In another method, the rail can be mounted in the same position but using stanchions located at either end of the pool of water. The stanchions add an element of portability to the apparatus and obviously would be required if a ceiling is not available above the pool.

It is therefore an object of the present invention to provide a support system for use in physical therapy performed in a pool of water that frees the hands of a therapist allowing the therapist full freedom for manipulative procedures.

Another object of the present invention is to provide a safe and secure support system for a swimmer undergoing lessons or training in a pool of water.

A further object of the present invention is to provide apparatus for supporting an individual in a therapeutic pool that enables the user to feel secure in the water, thereby allowing the user to perform therapeutic exercises in the water without fear of slipping below the surface.

Still another object of the present invention is to provide a means of support for individuals undergoing physical therapy in a pool of water that will decrease the amount of weight that must be supported by the user.

Yet another object of the present invention is to provide a support system for use in physical therapy in a pool of water that allows the user full freedom of movement.

Another object of the present invention is to provide a support system for physical therapy in water that does not interfere with the normal use of a swimming pool.

Another object of the present invention is to provide a support system for use in water that gives the user a sense of accomplishment and personal incentive.

Still another object of the present invention is to provide a support system for use in water that can be easily adjusted to the user's ability.

Yet another object is to provide a support system for use in a pool of water which can be adapted to the dimension and shape of the pool.

Another object of the present invention is to provide a support system for use in water that is easily installed in ceilings above indoor pools or supported by stanchions at each end of the pool.

Further, the support system of the present invention is relatively easy to use and maintain.

Still another object of the present invention is to provide a support system for use in water that is suitable for persons ranging from severely handicapped or rehabilitating orthopedic patients, to novice and accomplished competitive swimmers, or even other athletes such as competetive runners.

Another object of the present invention is to provide a support system for use in water physical therapy that allows a therapist to supervise more than one patient at a time if desired, thereby possibly reducing costs associated with water therapy.

These and other objects and advantages of the present invention will become more apparent from the following detailed description when taken in conjunction with the attached drawings.

DETAILED DESCRIPTION OF THE PREFERRED EMBODIMENT

Figure 1:
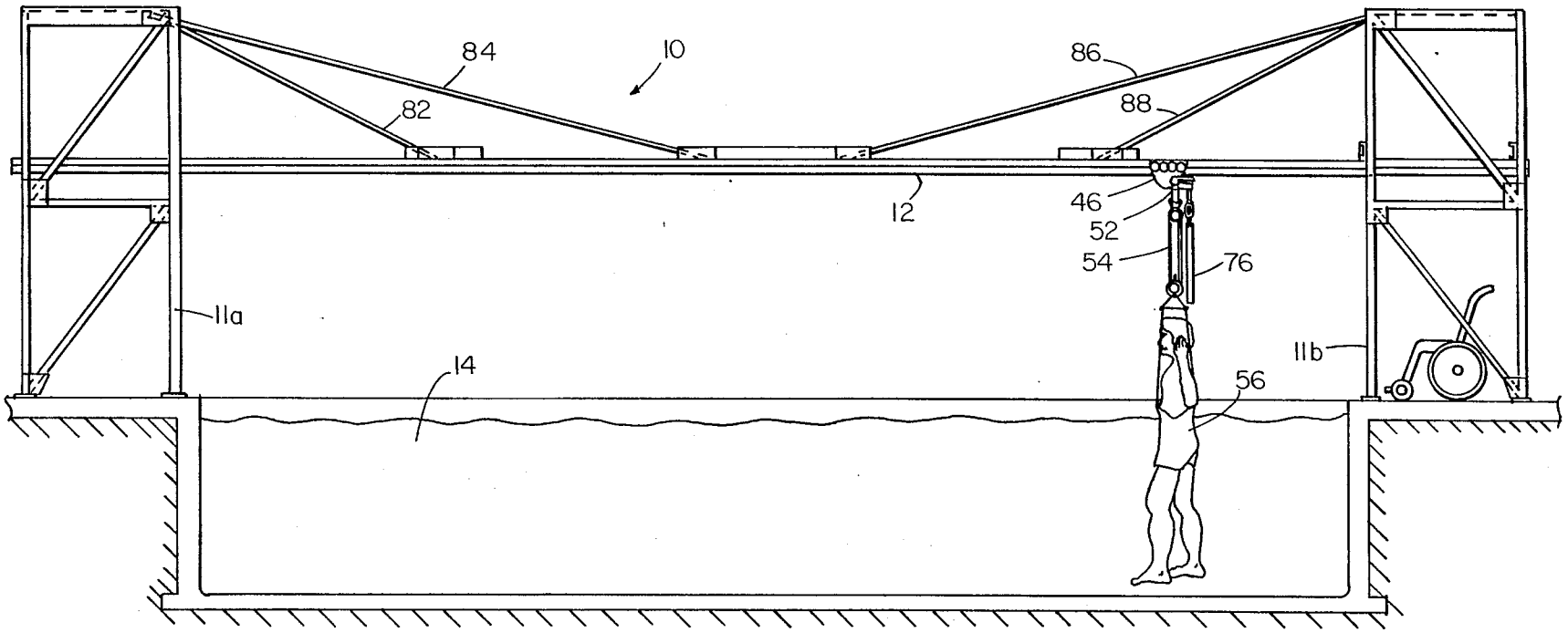
FIG. 1 is a schematic elevation view of the apparatus of the present invention with the rail mounted so as to provide portability to the apparatus.

Referring to the figures, the invention can be described. A support apparatus generally designated as 10 is shown which has a rail 12. The rail 12 can be mounted to stanchions 11*a* and 11*b* as shown in FIG. 1 or to the ceiling 13 above the pool of water 14 as shown in FIG. 4. The pool 14 can be a conventional swimming pool or any suitable pool of water for use in conjunction with support apparatus 10. Rail 12 is shown in greater detail in FIG. 3. Rail 12 is comprised of a central member 16 of a generally U-shaped cross section and having two flanges 18*a* and 18*b* on the lower portion thereof. An upper member 20 is also provided which has a U-shaped section, also best shown in FIG. 3. The upper member 20 is fastened by suitable fastening means such as bolts 22, 24, 26 and 28 to the central member 16 of the rail 12. An upper bar 30 located inside of central member 16 is provided and is fastened to both the central member 16 and upper member 20 forming an upper guide thereby. Lower bars 34 and 36 are located directly above the flanges 18*a* and 18*b* respectively. These lower bars are fastened to the sides of central member 16 by fasteners 38 and 40. The lower bars 34 and 36 form two tracks 42 and 44 within the rail 12.

Figure 2:
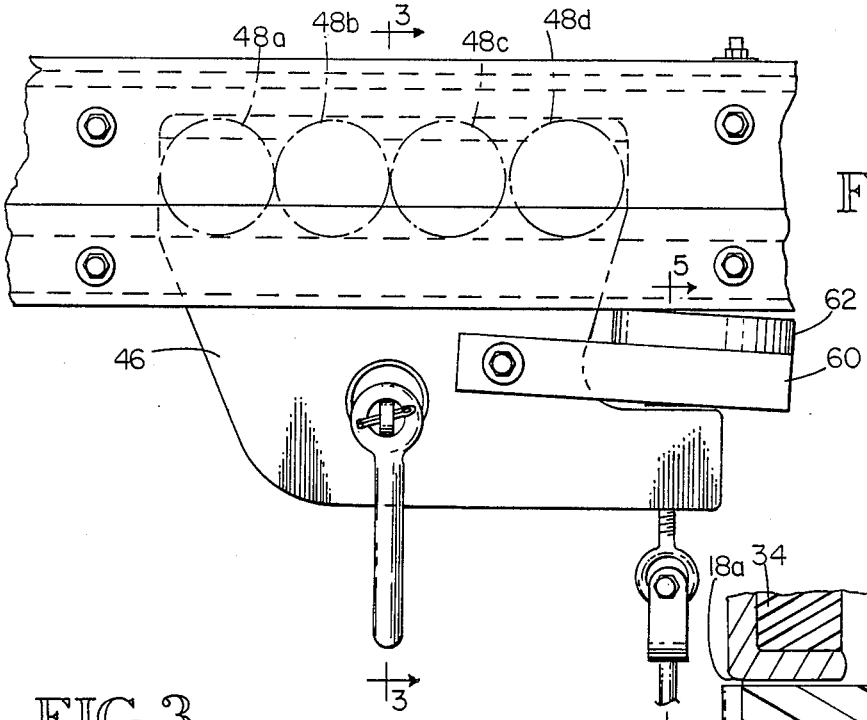
FIG. 2 is an elevation view showing the trolley in operative association with the rail of the present invention.
Figure 3:
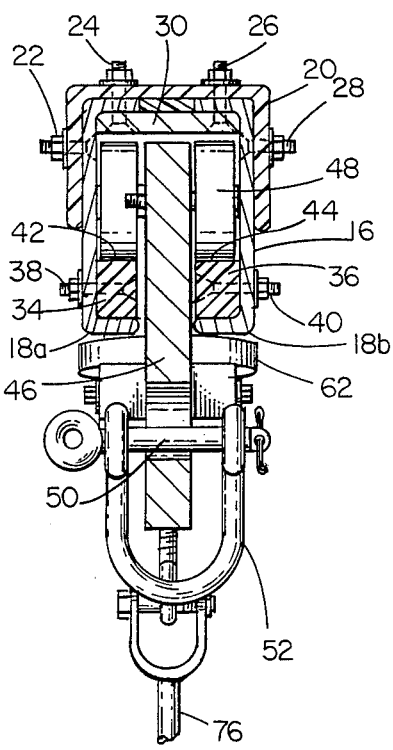
FIG. 3 is a cross sectional view of the rail and trolley of the present invention through line 3—3 of FIG. 2.
Figure 4:
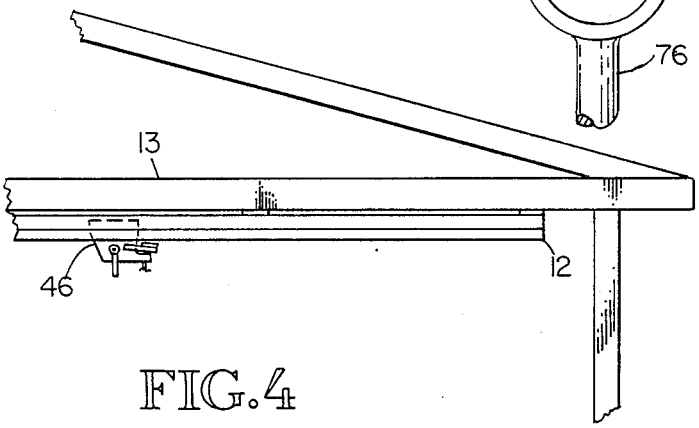
FIG. 4 is a partial elevation view of the apparatus of the present invention with the rail mounted to the ceiling above a pool of water.

Operatively associated with rail 12 is the trolley generally designated as 46 and shown in FIG. 2 and 3. Trolley 46 has a set of wheels designated 48*a*, 48*b*, 48*c*, and 48*d* which are guided and supported by tracks 42 and 44 of the rail 12 as best shown in FIG. 4. Wheels 48*a* & 48*c* are mounted on one side of trolley 46 and wheels 48*b* and 48*d* are mounted on the other side of trolley 46. The wheels can freely rotate and when associated with tracks 42 and 44 of rail 12 can cause the trolley 46 to move linearly within the rail 12. It should be noted that preferably the rail 12 can be of a thermoset plastic material such as fiberglass while the wheels can be of a thermoplastic material. These materials provide both corrosion resistance and strength. Trolley 46 is tapped in its lower center section to receive a pin 50 supporting a shackle 52. The shackle in turn is connected to one end of a conventional cable system 54 which eventually supports a user in a support jacket 56 or the like as shown in FIG. 1.

Figure 5:
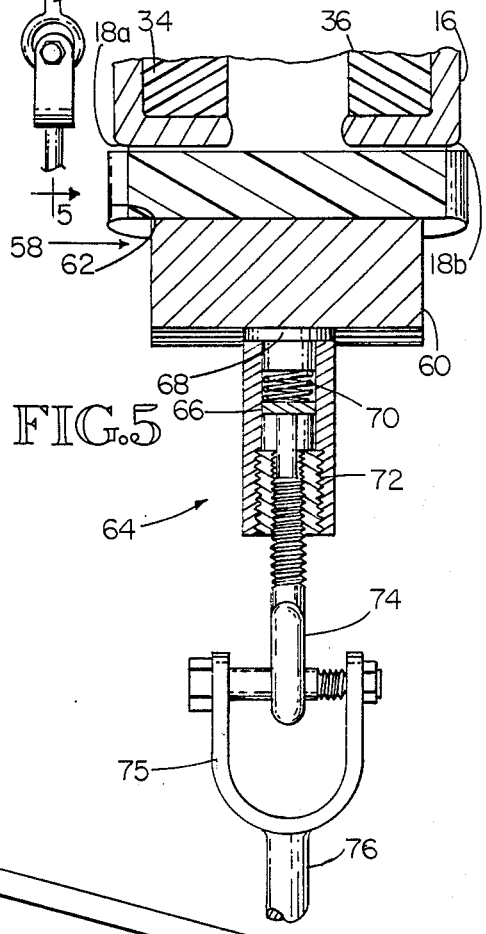
FIG. 5 is a cross sectional view of the trolley and brake of the present invention through line 5—5 of FIG. 2.

Referring to FIGS. 2 and 5, a braking system for the apparatus 10 is shown which is generally designated as 58. Braking system 58 has a brake arm 60 rotably mounted to trolley 46. Fixed to brake arm 60 is a brake pad 62 which when the braking system 58 is applied contacts the underside of flange 18*a* and 18*b* of rail 12 creating a drag against the rail and resulting in a greater force required by the user to move the wheels 48*a* through 48*d* of trolley 46 within the rail 12. The braking system 58 can apply a varying drag concluding at full drag thereby stopping movement of the trolley 46 within the rail 12. Brake arm 60 is controlled by drag assembly 64 shown best in FIG. 5. The assembly 64 is partially mounted in a tapped section 66 within trolley 46. The drag assembly 64 is comprised of a push plug 68, a spring 70, threaded insert 72 and an eye bolt 74. The operation of the drag assembly is relatively simple. The eye bolt 74 is turned clockwise in the threaded insert 72 forcing the spring 70 to compress and push the push plug 68 against the underside of brake arm 60. Brake arm 60 is slightly rotated creating contact between the brake pad 62 and the underside of flanges 18*a* and 18*b* of the rail 12. The eye bolt 74 allows a variation of the drag created between the brake pad 62 and the underside of flanges 18*a* and 18*b* from a no contact or "fully free" position to a "fully stopped" position with maximum drag. To allow the user of the apparatus to adjust the braking system 58, suitable linkage such as an appropriate shackle 75 between the eye bolt 62 and a drag adjusting rod 76 (FIG. 1) within reach of the user is provided. A simple turn of the rod 76 by the user, a therapist or an assistant, can then result in application or removal of the braking system 58.

In operation, the use of the support apparatus 10 would be straight-forward. A user would put on support jacket 56 either assisted or unassisted. The user supported by the apparatus could then linearly move within the water as the wheels 48*a* through 48*d* of the trolley 46 move within the rail 12. As described immediately above, rotation of the drag adjustment rod 76 by the user or another individual could apply a drag to the undersides of rail 12 and thereby increase the force needed for movement to be applied by the user. Using the apparatus, the user is free to move along the line of the rail 12, to stop and rest, or to vary the force needed to create and sustain movement in the water.

An alternative to a stanchion mounted rail is shown in FIG. 4. In all respects the apparatus would remain the same except for the mounting of the overhead rail 12 to a ceiling 13. It should be noted that the stanchions of FIG. 1 would be constructed in a conventional manner having a series of support rods 82, 84, 86, 88. Mounting of the rail by stanchion would be required if the pool was an outdoor pool not having a ceiling or in any case where portability of the apparatus was required.

Figure 6:
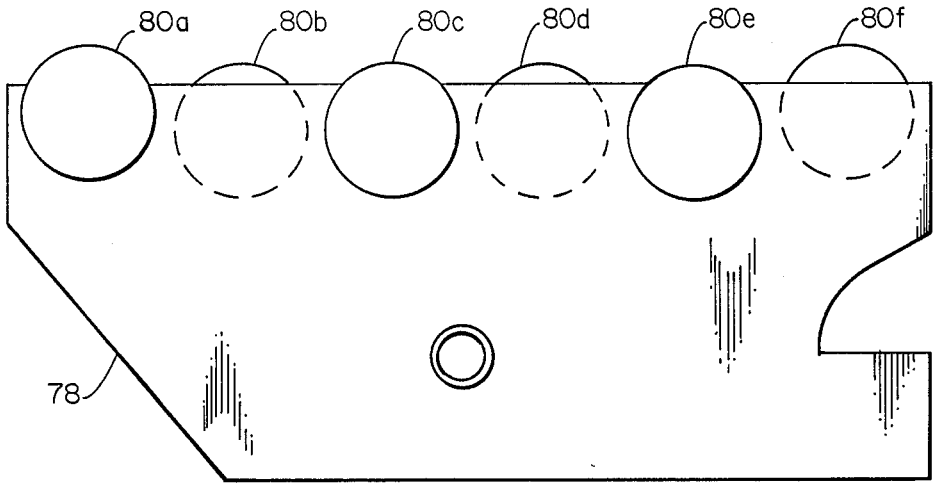
FIG. 6 is an elevation view similar to FIG. 2 showing an alternative embodiment of the trolley of the present invention.

FIG. 6 shows a trolley 78 which can be used alternatively to the trolley 46 shown in FIG. 2. In this embodiment, the trolley 78 has six wheels 80*a*, 80*b*, 80*c*, 80*d*, 80*e*, and 80*f*. Wheels 80*a*, 80*c* and 80*e* are mounted on one side of the trolley 78 while wheels 80*b*, 80*d*, and 80*f* are mounted on the other side of trolley 78. Wheels 80*a* and 80*f* are slightly higher than the other wheels and do not touch the tracks 42 or 44. The function of wheels 80*a* and 80*f* is to contact the lower side of bar 30 if the trolley 78 begins to tilt vertically during operation. This trolley embodiment will then prevent the trolley 78 from binding within rail 12 regardless of any possible tilting or other unbalancing vertical forces. To accommodate the added two wheels compared to trolley 46, trolley 78 has been lengthened in an obvious manner as shown in FIG. 6.

The invention may be embodied in other forms without departing from the spirit or essential characteristics thereof. The present embodiments are therefore to be considered in all respects as illustrative and not restrictive, the scope of the invention being indicated by the appended claims rather than the foregoing description, and all change which comes within the meaning and range of equivalency of claims are intended to be embraced therein.

What I claim is:

1. Apparatus for supporting a user in a pool of water comprising a. a lineal rail mounted above the pool of water, said rail having an underside and track means adapted to support wheels thereon;

b. a trolley having wheels and operatively associated with said rail whereby the wheels of said trolley are supported and guided by said track means of said rail;

c. support means having one end thereof connected to said trolley and the other end adapted to receive and support a user so that lineal movement by the user in the pool of water along the line of said rail results in lineal movement of said trolley along said rail as the user is supported in the pool of water;

d. brake means having a brake arm rotably mounted to said trolley and a brake pad fixed to said brake arm which contacts the underside of the rail when said brake means is applied, thereby braking said trolley.

2. The apparatus of claim 1 in which said brake means includes pushing means operatively associated with brake adjusting means whereby rotation of said brake adjusting means forces said pushing means to rotate said brake arm and push said brake pad against the underside of said trolley thereby braking said trolley.

3. The apparatus of claim 1 in which said trolley has at least two wheels which do not contact said track means unless said trolley is tilted vertically.

4. Apparatus for supporting a user in a pool of water located in a room having walls and a ceiling comprising, a. a room containing a pool of water;

b. a lineal rail mounted to the ceiling of the room containing said pool of water, said rail having an underside and track means adapted to support wheels thereon;

c. a trolley having wheels and operatively associated with said rail whereby the wheels of said trolley are supported and guided by said track means of said rail;

d. support means having one end thereof connected to said trolley and the other end adapted to receive and support a user so that lineal movement by the user in the pool of water along the line of the rail results in lineal movement of said trolley along said rail as the user is supported in the pool of water.

e. brake means having a brake arm rotably mounted to said trolley and a brake pad fixed to said brake arm which contacts the underside of the rail when said brake means is applied, thereby braking said trolley.

5. The apparatus of claim 4 in which said brake means includes pushing means operatively associated with brake adjusting means whereby rotation of said brake adjusting means forces said pushing means to rotate said brake arm and push said brake pad against the underside of said trolley thereby braking said trolley.

6. The apparatus of claim 4 in which said trolley has at least two wheels which do not contact said track means unless said trolley is tilted vertically.

* * * * *